US005145341A

United States Patent [19]

Drane

[11] Patent Number: 5,145,341

[45] Date of Patent: Sep. 8, 1992

[54] PROTECTIVE SHROUD FOR THE SHAFT OF A HELICAL GEAR PUMP

[75] Inventor: John Drane, Cheshire, United Kingdom

[73] Assignee: Mono Pumps Limited, Audenshaw, United Kingdom

[21] Appl. No.: 707,128

[22] Filed: May 31, 1991

[30] Foreign Application Priority Data

May 31, 1990 [GB] United Kingdom ..... 9012158

[51] Int. Cl.[5] ..... F04C 18/22

[52] U.S. Cl. ..... 418/48; 418/104; 418/181

[58] Field of Search ..... 418/48, 104, 181

[56] References Cited

U.S. PATENT DOCUMENTS

| | | | |
|---|---|---|---|
| 3,324,801 | 6/1967 | Fernholtz | 418/48 |
| 3,340,814 | 9/1967 | Streicher | 418/48 |
| 3,539,279 | 11/1970 | Rider et al. | 418/48 |
| 4,153,397 | 5/1979 | Allen . | |
| 4,639,200 | 1/1987 | Baumgardner et al. | 418/48 |
| 4,764,094 | 8/1988 | Baldenko et al. | 418/48 |

FOREIGN PATENT DOCUMENTS

| | | | |
|---|---|---|---|
| 1919647 | 1/1971 | Fed. Rep. of Germany | 418/48 |
| 2057860 | 1/1980 | Fed. Rep. of Germany | 418/48 |
| 2424424 | 11/1979 | France . | |
| 909116 | 10/1962 | United Kingdom . | |
| 1562277 | 3/1980 | United Kingdom . | |

*Primary Examiner*—Richard A. Bertsch
*Assistant Examiner*—David L. Cavanaugh
*Attorney, Agent, or Firm*—Fleit, Jacobson, Cohn, Price, Holman & Stern

[57] ABSTRACT

A helical gear pump in which a tubular shroud surrounds the drive shaft, the shroud being mounted in a housing of the pump at the end of the shroud remote from the stator and rotor, a seal being provided between the rotor and the tubular shroud.

3 Claims, 1 Drawing Sheet

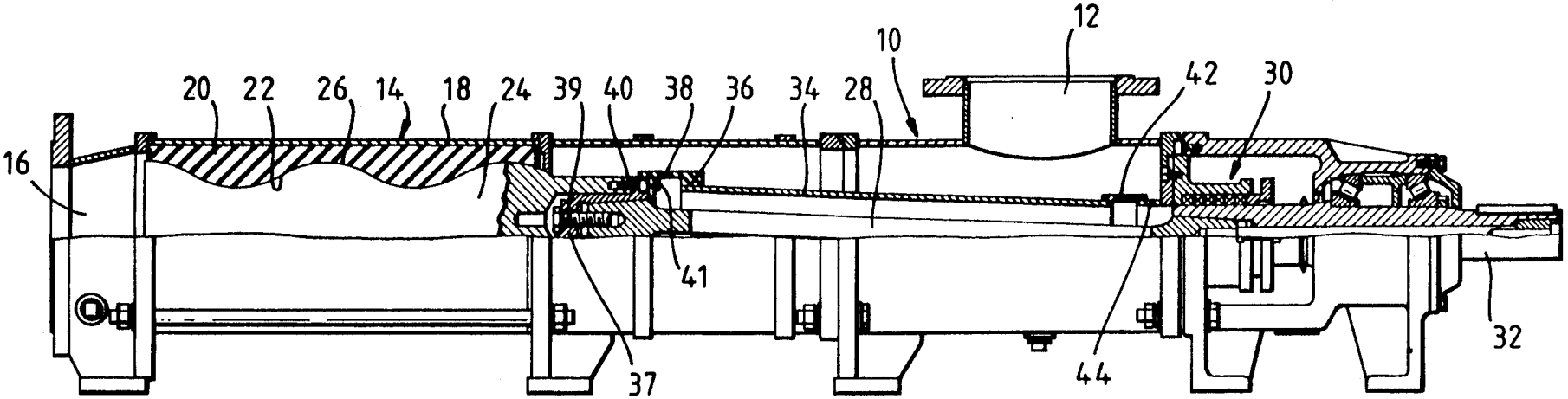
32
30
42
44
12
10
28
34
36
38
41
40
37
39
24
18
14
26
22
20
16

PROTECTIVE SHROUD FOR THE SHAFT OF A HELICAL GEAR PUMP

The present invent on relates to a helical gear pump. Such pumps comprise a housing having associated with it an inlet or outlet port to or from the housing. A stator is associated with one end of the housing and has a female helical gear formation having n starts, an outlet or inlet portion being provided at the end of the stator remote from the housing Mounted to be rotatable and orbital within the female helical gear formation is a rotor which has a male helical gear formation having n±1 starts.

A drive shaft which is either a flexible drive shaft or a shaft having a universal joint at one or both ends is used to drive the rotor and this in some instances is provided with a shroud to prevent fibrous or all like materials from wrapping around the drive shaft. While this in many instances does work satisfactorily, with fibrous pumped material the results are not always adequate.

It is now proposed, according to the present invention, for the shroud to be rigid and mounted in the housing at the end of the housing remote from the stator and rotor, for an annular seal to be provided between the rotor and the tubular shroud, said annular seal to bear on the outer or inner surface of the adjacent end portion of the tubular shroud and for a connection to be provided between the other end of the shroud and the housing to accommodate the resulting orbiting motion of the tubular shroud.

Such a structure prevents the pumped material from coming into contact with the drive shaft.

The connection may take a number of forms but in an advantageous structure, the connection comprises a stub tube connected rigidly to the housing and a flexible elastomeric sleeve which provides a flexible connection between the tubular shroud and the stub tube.

The seal may comprise a elongate ring secured to an end of the rotor, the ring being provided with a radially inner sealing face engaging the exterior of the tubular shroud.

In order that the present invention may readily be understood, the following description is given, merely by way of example, reference being made to the accompanying drawing in which the sole FIGURE is a schematic cross-section of said one embodiment of pump according to the invention.

A pump housing is indicated by the general reference numeral (10) and has communicating with it an inlet or outlet port (12). Mounted to the left of the housing (10) is the helical gear pump proper, indicated by the reference numeral (14). An inlet or outlet port (16) is shown to the left of the pump (14) which is shown as including a barrel (18) having molded therein a stator (20) having a female helical gear formation (22) with two starts. Rotatable within the female helical gear formation (22) is a rotor (24) having a male helical gear formation (26) of the same pitch but with only 1 start.

The rotor will be caused to rotate and orbit because of the interrelation between the two helical gear forms and the rotor is driven via a drive shaft (28), which is shown as being a flexible drive shaft of a conventional nature. This is driven via a seal assembly (30) by an input shaft (32) connected to a motor (not shown).

Surrounding the drive shaft (28) is a tubular shroud (34) having a diameter slightly larger than the external diameter of the drive shaft (28). The left end of the tubular shroud (34) is mounted in sealing contact with an annular seal (36) having a radially inner surface bearing against the exterior of the shroud (34). The rotor is connected to the drive shaft by way of an adaptor (37), secured to the drive shaft by a bolt (39), the adaptor being secured to the rotor by bolts (40). The seal (36) is mounted on an elongate ring (38) connected via bolts (41) to the rotor (24).

At the right hand end a flexible elastomeric sleeve (42) is engaged over the exterior of the shroud (34) and over the exterior of a stub tube (44) which is rigidly connected to the seal assembly (30).

In operation, when drive is applied via the shaft (32) to the flexible drive shaft (28), the rotor (24) is caused to rotate and to orbit. This induces an orbiting (but not a rotating) motion oh the shroud (34) which is allowed to move by the flexible elastomeric sleeve (42). Because there is no rotation of the shroud (34) there will be little tendency for fibrous material to become entangled around the shroud and the seal (36) between the exterior of the shroud (34) and the rotor prevents any fibrous material from contacting the drive shaft (28) or the rotor (30) before the pumped material flows into the cavities in the pump. This arrangement also makes the pump very suitable for operating in the reverse sense so that the port (16) becomes the inlet and the port (12) the outlet.

I claim:

1. A helical gear pump comprising a fixed pump housing, an inlet or outlet port to or from said pump housing, a stator associated with one end of said pump housing and having a female helical gear formation having n starts, an outlet or inlet port at the end of the stator remote from the fixed pump housing, a rotor rotatable and orbital within said female helical gear formation and having n±1 starts, a drive shaft connected to drive said rotor, said drive shaft passing through said fixed pump housing, a rigid tubular shroud surrounding said drive shaft, first and second ends to said rigid tubular shroud, means mounting said shroud at said first end thereof remote from said stator and rotor, an annular seal between said rotor and said tubular shroud at said second end, said annular seal bearing on the outer or inner surface of said second end portion of the tubular shroud, and an annular connection between said first end of the shroud and said pump housing to accommodate the resulting orbiting motion of the tubular shroud, said annular connection surrounding the drive shaft and being sealingly affixed to both the shroud and the pump housing so as to constrain the shroud against rotation.

2. A pump as claimed in 1, wherein said connection comprises a stub tube connected rigidly to the housing and a flexible elastomeric sleeve effective to provide a flexible connection between the tubular shroud and said stub tube.

3. A pump as claimed in 1, wherein said annular seal comprises an elongate ring secured to the end of the rotor, said ring being provided with a radially inner seal face, engaging the exterior of the tubular shroud.

* * * * *